US005450963A

United States Patent [19]

Carson

[11] Patent Number: 5,450,963

[45] Date of Patent: Sep. 19, 1995

[54] AIR REMOVAL DEVICE FOR SEALED STORAGE CONTAINER

[76] Inventor: James A. Carson, 2026 Imperial Golf Course Blvd., Naples, Fla. 33942

[21] Appl. No.: 199,642

[22] Filed: Feb. 22, 1994

[51] Int. Cl.[6] ..... B65D 81/20

[52] U.S. Cl. ..... 206/524.8; 206/522

[58] Field of Search ..... 206/522, 524.8; 383/100, 103; 137/852, 854

[56] References Cited

U.S. PATENT DOCUMENTS

| | | | |
|---|---|---|---|
| 3,423,939 | 1/1969 | Lewis et al. | 137/852 |
| 5,027,784 | 7/1991 | Osawa et al. | 137/854 |
| 5,121,840 | 6/1992 | Schram | 206/522 |
| 5,129,426 | 7/1992 | Boehmer | 137/852 |
| 5,142,970 | 9/1992 | ErkenBrack | 206/524.8 |
| 5,332,095 | 7/1994 | Wu | 206/524.8 |

FOREIGN PATENT DOCUMENTS

| | | | |
|---|---|---|---|
| 4189752 | 7/1992 | Japan | 206/524.8 |

*Primary Examiner*—David T. Fidei
*Attorney, Agent, or Firm*—Quarles & Brady

[57] ABSTRACT

An air removal device which extracts air from within an air tight flexible wall storage container such as a plastic storage bag, after the container has been sealed, to provide an internal environment of reduced atmospheric pressure within the container. The air removal device contains an air valve and housing which is releasably attached to the storage container providing a self contained mechanism for puncturing the device, inserting a single directional valve and air tight resealing housing thereon which can then be attached to an air removal pump. The invention employs employing air removal techniques to enhance the storage quality and life of perishables and other items.

23 Claims, 4 Drawing Sheets

AIR REMOVAL DEVICE FOR SEALED STORAGE CONTAINER

BACKGROUND OF THE INVENTION

1. Field of the Invention

This invention related to an air removal device for sealed storage containers having a flexible wall area, and more particularly, to the modification of sealed plastic storage bags with a device which removes air from within the sealed bag.

2. Description of the Prior Art

There are various storage containers, such as plastic storage bags that are available for storing goods and perishable items. These containers include specialized heat sealable and high pressure air tight self-sealable bags and non-air tight bags and wraps. It has been generally the practise that due to the material and construction resulting in air tight seals, that air removal from the bag is not accomplished after sealing. For example, heat sealable and high pressure sealable bags depend upon air removal prior to the sealing of the bag and then the application of heat or pressure is applied to produce an air tight seal.

There are devices available, such as Pump N Seal, Pro Seal: Seal A Meal and DENI VACUUM FOOD SEALER, which are effective in removing air from open bags and then sealing the air tight, flexible, plastic bags which is generally performed with the use of heat or high pressure sealing devices. While in some instances these devices remove air from self-sealing flexible storage containers they are unable to perform the function after filling of the bag and thus are unable to afford optimized air removal. Such devices do not attach to flexible wall storage containers and do not allow for the easy reuse and resealing of the flexible wall storage units.

Hence, as can be seen from the above, there is a need for an air removal device which will attach to sealed flexible wall storage containers, such as flexible plastic wall storage bags, for the storage of perishable and non-perishable goods in a reduced atmospheric pressure environment.

SUMMARY OF THE INVENTION

Accordingly, it is an object of the invention to provide a unique, efficient and inexpensive device for the removal of air from a sealed flexible container.

It is another object to provide such a device which will attach to a reusable container so that air can be removed from the refilled container after each refilling and sealing operation.

It is a further object to provide such a device that can be removed from one container and reused on another container.

The invention provides a device containing a valve enclosed within the upper and lower units of a valve housing which is attached to the wall of a sealed storage container to remove air therefrom. The storage container must have at least one flexible wall area, such as a plastic bag or other flexible wall container, which can be punctured by the valve. The valve housing units surround the value and punctured opening to effect an air tight seal by sandwiching the wall between its upper and lower units. After the storage container has been filled with perishable or non-perishable material, it is sealed. The valve is then attached to an air removal pump, or similar device, which removes enclosed air and creates a low atmosphere storage environment within the container. After the container has been reused, it may be resealed and the enclosed air removal procedure repeated.

BRIEF DESCRIPTION OF THE DRAWINGS

Although such novel features believed to be characteristic of the invention are pointed out in the claims, the invention and the manner in which it may be carried out may be further understood by reference to the following disclosure and to the accompanying drawings.

DESCRIPTION OF THE PREFERRED EMBODIMENT

Figure 1:
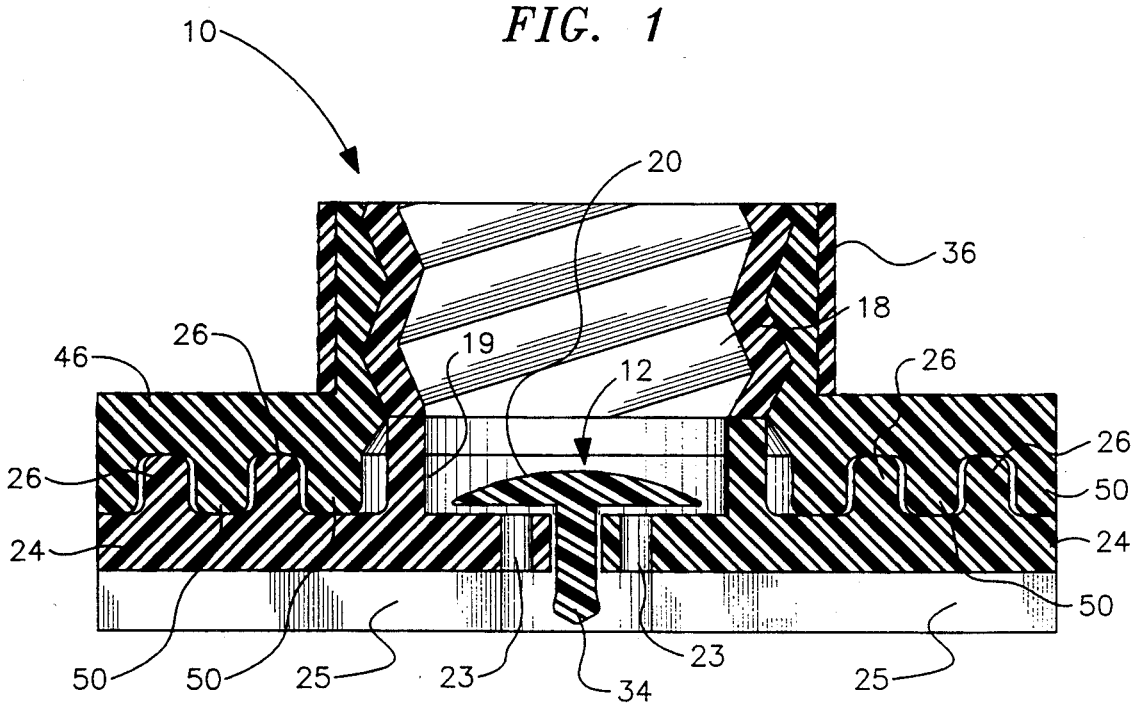
FIG. 1 cross sectional is a view of the air removal device of the invention.
Figure 2:
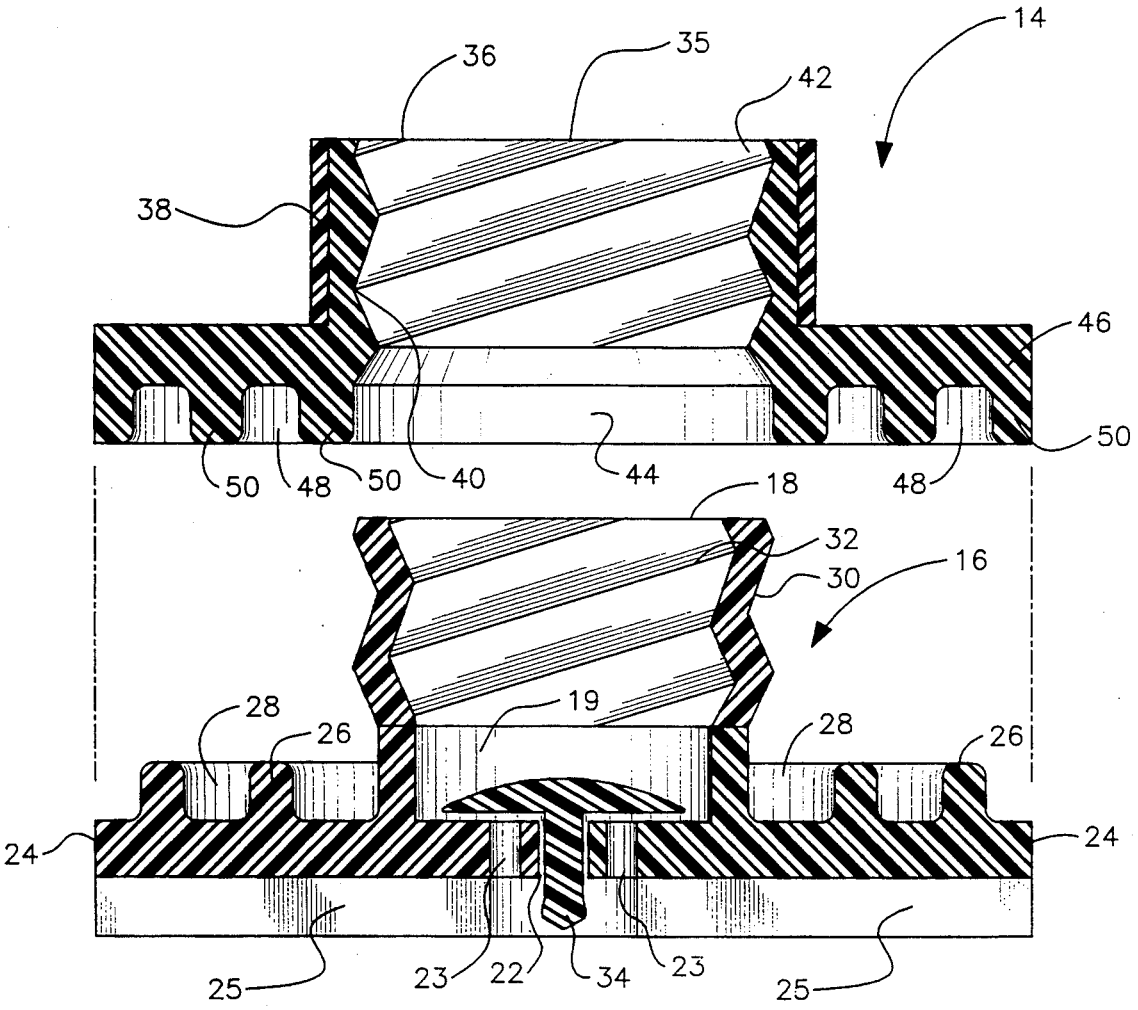
FIG. 2 is a cross sectional view of the separated upper and lower housings of the air removal device.

Shown in FIG. 1 is the air removal device 10 of the invention. Device 10 includes a single directional valve 12, and individual upper housing 14 and a lower housing 16 as seen in FIG. 2. The single directional valve 12 can be an umbrella valve as shown on other similar single directional valve. The valve 12 has a stem 34 and an expanded flange 20 which is frictionally engaged within the lower space 13 of central core 18 of the lower housing.

The lower housing 16 is circular in shape and is constructed to be securely engaged within the upper housing 14. The lower housing includes vertical lower central core 18 having a bottom air opening 22 surrounded by smaller air openings 23, therein, and lower fins 24. Lower central core 18 has a vertical, accordian shaped wall 30 with exterior threads 32 in its upper portion as shown in FIG. 2. The lower fins 24 which encircle lower central core 18 have on the upper surface a number of spaced apart, adjacent annular male ridges 26 and female valleys 28. Valve 12 includes a flange 20 and stem 34 which are prepared from flexible rubber material. The valve 12 is fitted upwardly through opening 22 where it expands to flange 20 and becomes engaged within the bottom area 21 of central core 18. Valve stem 34 extends downwardly into opening 22 from the flange as seen in FIG. 2.

The structure of upper housing 14 is similar to that of lower housing 16 in order for it to be securely attached to the lower housing. The upper housing 14 includes an air opening 35 leading into a vertical upper central core 36 having a circular outer wall 38, an accordian shaped inner wall 40 with internal threads 42 and a lower space 44 to accommodate the valve flange 20. Encircling upper central core 36 are upper fins 46 which include in the lower surface a number of spaced apart adjacent annular female valleys 48 and male ridges 50 which are positioned to coincide with their mating counterparts in the lower housing 16 in order to form a secure attachment. As seen in FIG. 2, the male ridges 26 and female valleys 28 of the lower housing 16 are directly opposite to the female valley, 44 and male ridges 46 of upper housing 14, and lower central core 18 is likewise directly opposite to upper central core 36, so that when fitted together they form the air removal device 10 as shown in FIG. 1.

Figure 3:
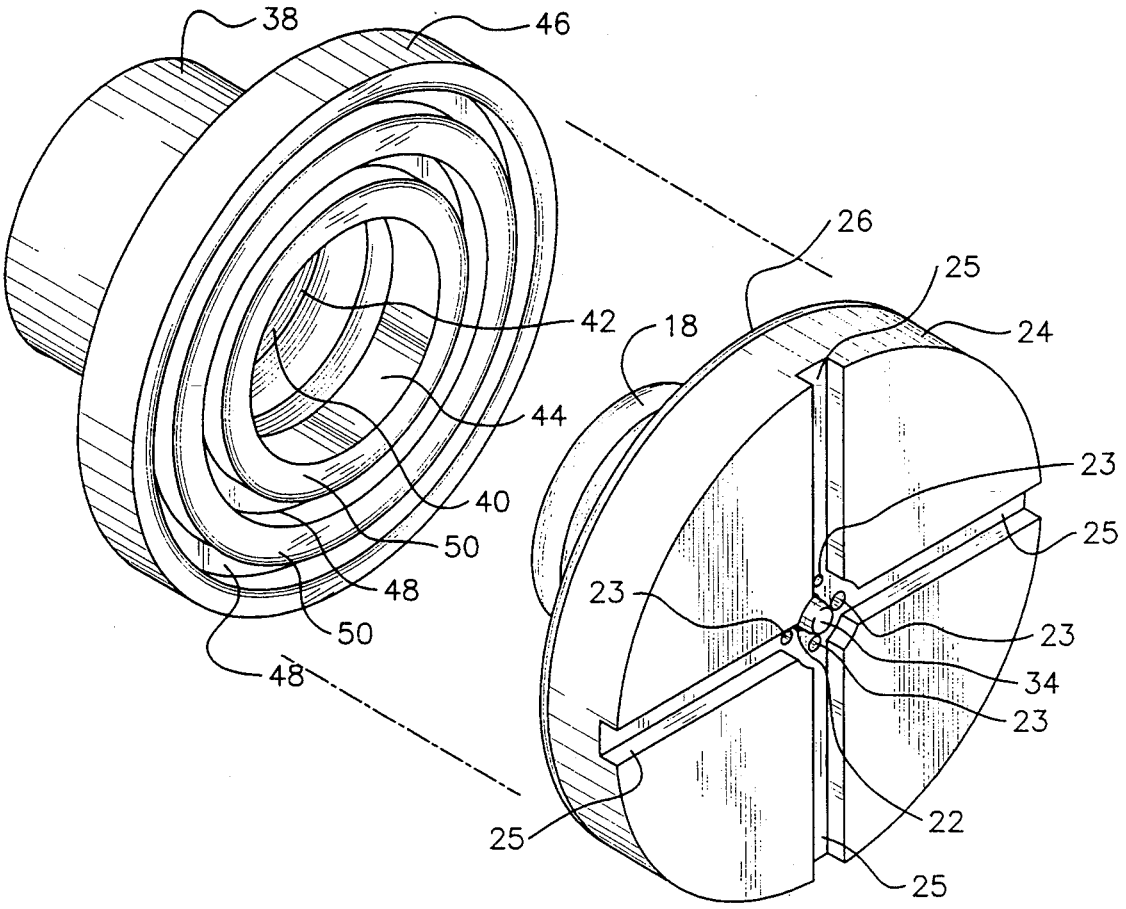
FIG. 3 is a perspective view of the air removal device housings to be joined together.

Shown in FIG. 3 is a perspective view of the upper and lower housings opposing one another in the process of being joined together. As seen therein, lower central core 18 will fit within upper central core 36 while upper female valleys 48 and upper male ridges 50 will join together with their mating lower ridges and lower valleys. Lower space 44 and inner accordian shaped wall 40 of upper central core 36 will encompass the bottom core and the accordian shaded wall of the lower central core 18. Upper fins 46 will couple with lower fins 25 exposing upper circular wall 38.

Figure 4:
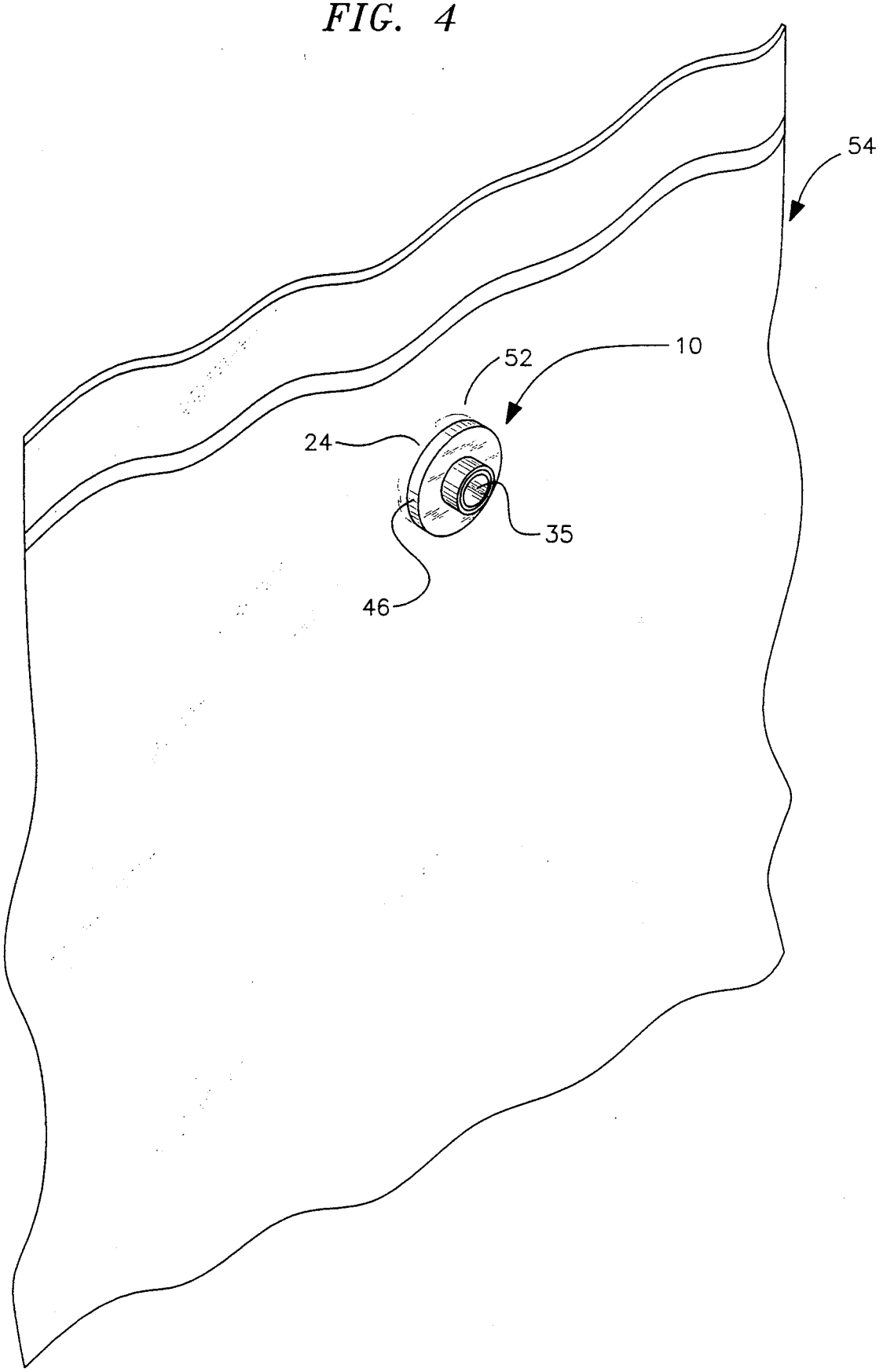
FIG. 4 is a view of the air removal device attached to a plastic bag.

Also shown in FIG. 3 are multiple ridges 25 radiating from openings 23 and 22, having valve stem 34 therein, on the bottom surface of the lower housing. As seen in FIG. 4 the lower housing is attached to the inner surface of plastic bag 54. Ridges 25 prevent the flexible wall 52 of the plastic bag from blocking air openings 22 and 23 when air is removed from the plastic bag thus enhancing air removal therefrom.

FIG. 4 shows the air removal device 10 of the invention attached to plastic bag 54 having a flexible wall 52. The upper housing is joined to the lower housing as shown in FIGS. 1, 2 and 3 with the central cores and mating male and female ridges joined together. This structure creates a pinch point receiver for securing device 10 to the bag 54 by sandwiching and compressing the flexible wall 52 within the joined ridges and valleys of the tipper fins 46 and lower fins 24. The sandwiched and compressed flexible wall of the plastic bag now act as a sealer or "0" ring thus creating an air tight seal in flexible wall 52 of the bag. Opening 35 in the upper housing allows the removal of air enclosed within the bag.

The upper and lower housings are cast from plastic material. The upper central core 36 is releasably attached to the lower central core 18 by connecting screw threads 32 and 42 which permits reuse with difficult bags or as a permanent attachment to one bag.

The function of the male ridges and female valleys when joined together is to ensure proper air flow. This is accomplished by preventing air impedance which could result from the air removal orifices being clogged or blocked by the flexible plastic wall sheeting material or other substance.

The function of ridges 25 is to prevent the flexible wall from being sucked in and blocking air openings 22 and 23.

The umbrella valve 12 is a single directional valve cast from as elastomeric material which attaches to the lower valve housing through opening 22. When attached to the flexible wall of the storage container, the device may be attached to an air removal pump which will remove air from within the sealed storage container by lifting valve flange 20 and stem 34 and allowing air to mass through openings 22 and 23 and producing low atmospheric environment inside the storage container. The one storage bag may be used and resealed a number of times while the air removal process is continually applied to the resealed container by simply attaching the air removal pump. The releasably attached air removal device 10 of the invention also may be used on different storage units by removing it from one container and attaching it to another container.

While a preferred embodiment of the invention as shown in the drawings utilizes a five point seal of the ridges and valleys in the housings, the invention encompasses using a greater or lesser number pinch points of contact for sealing as the situation requires. The elastomeric and plastic materials used for the valve and housings may be substituted with any other suitable material including metals or other configurations.

The benefits of low atmosphere storage of perishable and other items is widely accepted; the ease of use and multi use nature of the invention allows for greater proliferation of low atmosphere storage. The degree of atmosphere reduction is only dependent on the level of air removal pump ability and the rating of individual flexible storage units utilized.

It will apparent to those skilled in the art from the foregoing description and accompanying drawings that additional modifications and/or changes of the disclosed embodiments may be made without departure from the invention.

What is claimed is:

1. An air impermeable sealed storage container having a flexible wall area with an interior and an exterior surface comprising:

said wall area having a vented opening therein and an air valve within a valve housing mounted thereon, said valve housing providing a lower unit and an upper unit, each unit having central opening, each unit having an inner surface and an outer surface, each inner surface containing at least two of male and female components, said air valve coupled within said lower unit, said lower unit inner surface being mounted on said interior wall surface wherein said air valve encloses said vented opening and the lower unit central opening, said at least two of male and female components engaging said interior surface of said flexible wall, said upper unit inner surface being mounted on said exterior wall surface wherein its at least two of male and female components engage said lower units mating at least two of female and male components, thereby forming a plurality of sets of interengaging sealing members for compressing the engaged wall area therebetween and sealing said air valve within said upper and lower units, whereby air within said sealed container is removed through said central opening with an air removal device.

2. A storage container according to claim 1 wherein said air valve is a single directional valve.

3. A storage container according to claim 2 wherein said single directional valve is an umbrella valve.

4. A storage container according to claim 3 wherein said umbrella valve is a flexible rubber valve.

5. A storage container according to claim 1 wherein the structure of each of said housing units contains a vertical central core leading to its central opening which central cores are joined together.

6. A storage container according to claim 5 wherein said male and female components are mounted on outer fins encompassing said central core.

7. A storage container according to claim 6 wherein said joined together central cores enclose the air valve therein.

8. A storage container according to claim 7 wherein each of said housing units forms a circular structure.

9. An air impermeable sealed storage container having a flexible wall area with an interior and an exterior surface comprising:

said wall area having a vented opening therein and an air valve within a valve housing mounted thereon, said valve housing providing a lower unit and upper unit, each unit having a central opening, each unit having an inner surface and an outer surface, each inner surface containing male and female components, said air valve being coupled within said lower unit, said lower unit inner surface being mounted on said interior wall surface, wherein said air valve encloses said vented opening and the lower unit central opening, said lower unit male and female components engaging said interior wall, said upper unit inner surface being mounted on said exterior wall surface wherein its male and female components engage said lower unit's mating female and male components, thereby compressing the engaged wall area therebetween and sealing said air valve within said and lower units, whereby air within said sealed container is removed through said central openings with an air removal device and wherein a plurality of radial ridges extend from the central opening on the lower unit outer surface.

10. A storage container according to claim 9 wherein said housing units are prepared from a plastic material.

11. An air removal device which extracts air from within a sealed container having a flexible wall area with an interior and exterior surface, comprising:

an air valve coupled within a valve housing, said valve housing providing a lower unit and an upper unit, each unit having a central opening, each unit having an inner surface and an outer surface, each inner surface containing at least two of male and female components, said valve attached within said lower unit, said lower unit inner surface being capable of mounting on the interior wall surface wherein said valve encloses an opening in said wall surface and the lower unit central opening, and said at least two of male and female components engaging said interior wall, said upper unit inner surface being capable of mounting on said exterior wall surface wherein its at least two male and female components engage said mating at least two of female and male components, thereby forming a plurality of sets of interengaging sealing members to compress the engaged wall area therebetween and seal said air valve within said upper and lower units, whereby air within said sealed container is removed through said central opening with an air removal device.

12. A device according to claim 11 wherein said air valve is a single directional valve.

13. A device according to claim 12 wherein said valve is an umbrella valve.

14. A device according to claim 13 wherein said umbrella valve is a flexible rubber valve.

15. A device according to claim 11 wherein the structure of each housing unit contains a vertical central core which central cores are capable of joining together.

16. A device according to claim 15 wherein said male and female components are mounted on outer fins encompassing said central core.

17. A device according to claim 16 wherein said joined together central cores enclose the air valve therein.

18. A device according to claim 17 wherein said housing units form a circular structure.

19. An air removal device which extracts air from within a sealed container having a flexible wall area with an interior and exterior surface, comprising:

an air valve coupled within a valve housing, said valve housing providing a lower unit and an upper unit, each unit having a central opening, each unit having an inner surface and an outer surface, each inner surface containing male and female components, said valve attached within said lower unit, said lower unit inner surface being capable of mounting on the interior wall surface wherein said valve encloses an opening in said wall surface and the lower unit central opening, and said male and female components engage said interior wall, said upper unit inner surface being capable of mounting on said exterior wall surface wherein its male and female components engage said lower units mating female and male components to compress the engaged wall area therebetween and seal said air valve within said upper and lower units, whereby air within said sealed container is removed through said central opening with an air removal device and wherein a plurality of radial ridges extend from the central opening on the lower unit outer surface.

20. A device according to claim 19 wherein said housing units are prepared from plastic materials.

21. The air removal device according to claim 11, wherein said plurality of sets of interengaging sealing members are annularly and concentrically arranged around said central openings.

22. The air removal device according to claim 15, wherein each central core provides a thread surface mated to the thread surface of the other central core for removably engaging the mating thread surface of the other central core, whereby the upper unit and the lower unit can be screwed together to compress the container wall disposed therebetween and unscrewed for reuse with another container.

23. An air removal device which extracts air from within a sealed container having a flexible wall area with an interior and exterior surface, comprising:

a valve housing having an air valve, said valve housing providing a lower unit and an upper unit, said upper unit being separable from said lower unit, each unit having a central opening, each unit having an inner surface and an outer surface, each inner surface containing at least two sealing members for interengaging a mating sealing member of the other inner surface, each sealing member being one of a raised projection from an inner surface and a depression in an inner surface, said valve being attached within said lower unit, said lower unit inner surface being capable of mounting on the interior wall surface wherein said valve housing can enclose an opening in said wall surface, the lower unit central opening being closed by the air valve, said upper unit inner surface being capable of mounting on said exterior wall surface wherein its at least two sealing members can engage the mating sealing members of the other inner surface, thereby forming a plurality of sets of interengaging sealing members to compress the engaged wall area therebetween and seal said air valve within said upper and lower units, whereby air within said sealed container can be removed through said central openings with an air removal device.

* * * * *